United States Patent [19]

Stech

[11] 3,949,567

[45] Apr. 13, 1976

[54] CENTRIFUGAL PUMP ASSEMBLY

[75] Inventor: Peter Stech, Platjenwerbe near Bremen, Germany

[73] Assignee: K S B Kernkraftwerkspumpen GmbH, Frankenthal, Pfalz, Germany

[22] Filed: Jan. 10, 1974

[21] Appl. No.: 432,343

[30] Foreign Application Priority Data

Jan. 16, 1973 Germany ..... 2301961

[52] U.S. Cl. ..... 64/9 R; 64/6; 403/287; 433/301; 415/122 R

[51] Int. Cl. ..... F16d 3/18

[58] Field of Search ..... 64/23, 6, 9, 1 C, 1 R; 192/110 S; 403/286, 287, 301; 415/126, 122

[56] References Cited

UNITED STATES PATENTS

| | | | |
|---|---|---|---|
| 521,677 | 6/1894 | Smith | 64/1 C |
| 2,830,801 | 4/1958 | Stratienko et al. | 403/286 |
| 2,959,943 | 11/1960 | Allen | 64/9 |
| 3,282,614 | 11/1966 | Entrikin | 403/301 |
| 3,306,076 | 2/1967 | Cashman et al. | 64/23 |
| 3,487,432 | 12/1969 | Jensen | 415/122 |

*Primary Examiner*—Samuel Scott
*Assistant Examiner*—Randall Heald
*Attorney, Agent, or Firm*—Michael J. Striker

[57] ABSTRACT

A centrifugal pump assembly for use in nuclear reactor plants has a vertical motor shaft, a vertical pump shaft which is coaxial with and is located below and spaced apart from the motor shaft, an intermediate shaft which is coaxial with and is located between the pump shaft and motor shaft, a flexible coupling between the lower end of the motor shaft and the upper end of the intermediate shaft, and a rigid coupling between the upper end of the pump shaft and the lower end of the intermediate shaft. The intermediate shaft is rotatable in radial and/or axial bearings which are installed in a stationary housing, and the intermediate shaft is movable axially of the housing between a lower end position in which the rigid coupling is engaged and a raised position in which the rigid coupling is disengaged and the bearings and/or seals for the pump shaft are accessible.

10 Claims, 3 Drawing Figures

CENTRIFUGAL PUMP ASSEMBLY

CROSS-REFERENCE TO RELATED APPLICATION

The centrifugal pump assembly of the present invention constitutes an improvement over and a further development of centrifugal pump assemblies disclosed in the commonly owned copending application Ser. No. 426,629 filed Dec. 12, 1973 by Honold et al.

BACKGROUND OF THE INVENTION

The present invention relates to centrifugal pump assemblies, and more particularly to improvements in upright pump assemblies which may constitute the primary recirculating pump of nuclear reactor plants, for example, pressurized water reactors.

It is known to provide a centrifugal pump assembly for use in nuclear reactor plants with three coaxial shafts including a lower shaft or pump shaft, an upper shaft or motor shaft, and an intermediate shaft for the necessary radial and/or thrust bearings. The motor shaft is driven by a prime mover and rotates the intermediate shaft through the medium of a flexible coupling. The intermediate shaft rotates the pump shaft through the medium of a rigid coupling. In order to allow an attendant to gain access to the friction bearings and/or sealing elements for the pump shaft, the conventional assemblies normally employ a removable elongated insert which is secured in the pump assembly between the elements of the rigid coupling by two additional coupling elements. This insert and the additional coupling elements contribute to the overall length, bulk and cost of the pump assembly.

SUMMARY OF THE INVENTION

An object of the invention is to provide a novel and improved centrifugal pump assembly wherein the parts which require frequent inspection are readily accessible and wherein such accessibility is achieved without adding to the bulk and/or complexity of the assembly.

Another object of the invention is to provide a centrifugal pump assembly wherein the torque-transmitting connection between the output shaft of the prime mover and the pump shaft is shorter, more rugged, more reliable and less expensive than in heretofore known pump assemblies.

A further object of the invention is to provide novel and improved means for transmitting torque from the shaft of the prime mover to the pump shaft in an upright centrifugal pump assembly.

An additional object of the invention is to provide a centrifugal pump assembly which can be used as a superior substitute for conventional pump assemblies in existing nuclear reactor plants.

The invention is embodied in a centrifugal pump assembly, particularly in an upright centrifugal pump assembly for use in nuclear reactor plants. The improved assembly comprises a motor shaft, a pump shaft which is coaxial with and spaced apart from the motor shaft, a stationary housing which is mounted in an apertured enclosure intermediate the pump shaft and motor shaft, an intermediate shaft which is coaxial with the pump shaft and motor shaft and is rotatable in the housing, radial and/or axial friction bearings provided for the intermediate shaft in the stationary housing, a preferably flexible first coupling which serves to transmit torque from the motor shaft to the intermediate shaft, and a preferably rigid second coupling which normally serves to transmit torque from the intermediate shaft to the pump shaft.

In accordance with a feature of the invention, the intermediate shaft is movable axially between a first position in which the second coupling is engaged and a second position in which the second coupling is disengaged and the bearings and/or sealing means for the pump shaft are readily accessible.

The flexible coupling may comprise a first coupling element on the motor shaft, a second coupling element on the intermediate shaft and a preferably sleeve-like third coupling element which transmits torque from the first to the second coupling element, at least in the first axial position of the intermediate shaft. The second and/or third coupling element is movable axially with the intermediate shaft; the arrangement is preferably such that the third coupling element is in permanent torque-receiving engagement with the first coupling element and the second coupling element is movable axially with the intermediate shaft and can receive torque from the third coupling element at least when the intermediate shaft dwells in the first position.

The second coupling may comprise a first set of teeth at one end face of the intermediate shaft, a second set of teeth at one end face of the pump shaft, and means for normally holding the teeth of the first set in mesh with the teeth of the second set. Such means for holding may comprise a composite sleeve which holds the intermediate shaft against axial movement from its first position but is detachable to thereby permit the intermediate shaft to move to its second position. Other types of rigid couplings between the intermediate shaft and the pump shaft can be used with equal advantage.

The intermediate shaft is preferably located at a level above the pump shaft but below the motor shaft.

The novel features which are considered as characteristic of the invention are set forth in particular in the appended claims. The improved pump assembly itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
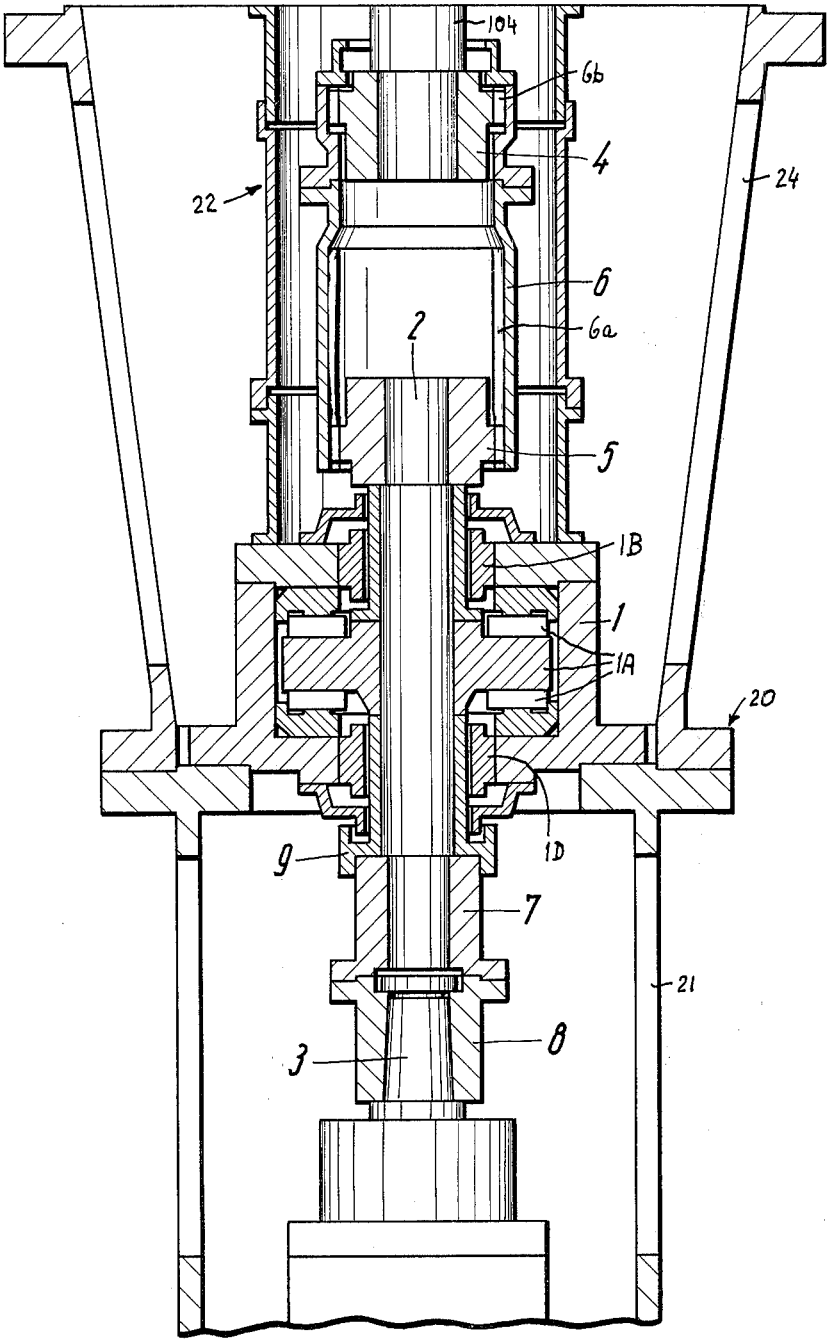
FIG. 1 is a fragmentary axial sectional view of a centrifugal pump assembly with the intermediate shaft shown in its operative position in which it transmits torque to the pump shaft.

FIG. 1 shows the centrifugal pump assembly in assembled condition. An intermediate shaft 2 which serves to transmit torque from a motor shaft 104 to a pump shaft 3 is shown in its lower end position whereby a coupling element 7 at the lower end of the intermediate shaft 2 engages with a complementary coupling element 8 at the upper end of the pump shaft 3. The shaft 2 is in permanent torque-receiving engagement with the motor shaft 104 through the medium of a flexible coupling including a distancing sleeve 6 having internal teeth 6a in mesh with the external teeth of a coupling element 5 at the upper end of the shaft 2. A second set of internal teeth 6b at the upper end of the distancing sleeve 6 is in permanent mesh with the teeth of a coupling element 4 at the lower end of the motor shaft 104. The shaft 2 is surrounded by a stationary housing 1 which is secured to a casing or enclosure 20 and contains radial and/or thrust bearings for the shaft 2.

Figure 2:
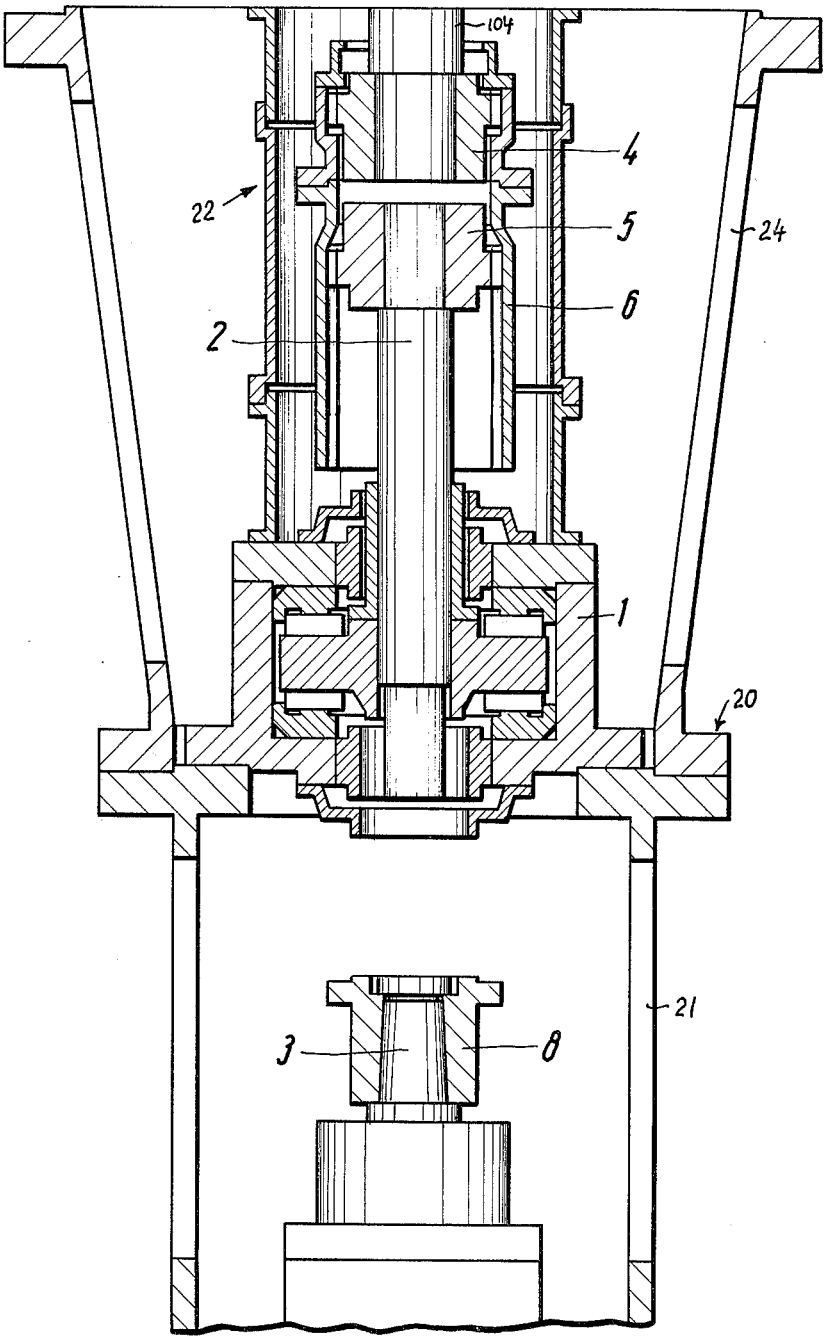
FIG. 2 is a similar axial sectional view but showing the intermediate shaft in raised position and with certain parts removed.

In FIG. 2, the intermediate shaft 2 is shown in a raised position in which its lower end is located at a level above the coupling element 7 (not shown) so that the latter can be removed through one of the openings or apertures 21 in the lower portion of the enclosure 20. The raised intermediate shaft 2 also permits for removal of a sleeve 9 (FIG. 1) which normally surrounds the shaft 2 in the region above the coupling element 7. The space between the housing 1 and the coupling element 8 is then large enough to afford access to the sealing means for the pump shaft 3 and/or to the friction bearings for the shaft 3.

The means for moving the intermediate shaft 2 between the end positions shown in FIGS. 1 and 2 may comprise a hydraulic or pneumatic lifting device, not shown.

Figure 3:
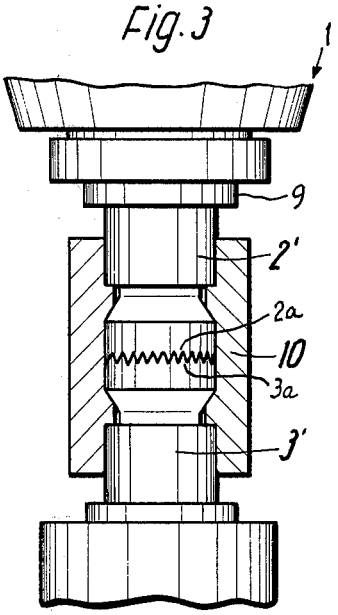
FIG. 3 is an axial sectional view of a modified rigid coupling between the pump shaft and the intermediate shaft.

FIG. 3 shows a modified rigid coupling between the shafts 2' and 3'. This coupling replaces the rigid coupling 7, 8 of FIGS. 1–2 and comprises teeth **2*a* on the lower end face of the shaft 2' in mesh with teeth 3*a* on the upper end face of the shaft 3'. The teeth 2*a*, 3*a* are normally held in mesh by a composite sleeve 10 which comprises two or more separable sections enabling an operator to remove the sleeve 10 and to thus allow the intermediate shaft 2' to move to its upper end position corresponding to the position of the shaft 2 shown in FIG. 2. The sections of the sleeve 10** preferably resemble troughs or shells which are held together by screws, bolts or analogous fasteners, not shown.

Referring again to FIGS. 1 and 2, the distancing sleeve 6 is surrounded by a shroud 22 which may consist of several cylindrical sections and extends between the housing 1 and the housing (not shown) of the motor including the shaft 104. The coupling including the sleeve 6 and coupling elements 4, 5 is accessible through one or more openings or apertures 24 in the upper part of the enclosure 20. The sections of the shroud 22 can be assembled in a manner as described for the sleeve 10 so that they can be removed in order to afford access to the flexible coupling 4–6 and to the upper side of the housing 1.

The housing 1 of FIGS. 1 and 2 contains a double-acting thrust bearing 1A between two hydrodynamic radial journal bearings 1B, 1D.

An advantage of the improved pump assembly is that the sealing means and/or the friction bearings for the pump shaft 3 or 3' are readily accessible for inspection, maintenance and/or replacement by the simple expedient of moving the intermediate shaft 2 or 2' axially with respect to the housing 1. Such accessibility does not affect the rigidity and reliability of the torque-transmitting connection between the shafts 104, 3 or 104, 3'; on the contrary, the connection is relatively short and hence more reliable than in many presently known pump assemblies employing shafts of identical diameters. The flexible coupling 4–6 is accessible through the opening or openings 24 upon removal of the shroud 22, and the rigid coupling between the shafts 2, 3 or 2', 3' is accessible at any time through the opening or openings 21. Since the housing 1 remains stationary, the relatively short distance between the bearings for the shafts 2, 3 or 2', 3' need not be increased at any time, i.e., such distance remains unchanged irrespective of the axial position of the shaft 2 or 2'. The rigid coupling of FIG. 3 contributes to an additional reduction of the overall distance between the motor and the pump.

Without further analysis, the foregoing will so fully reveal the gist of the present invention that others can, by applying current knowledge, readily adapt it for various applications without omitting features which fairly constitute essential characteristics of the generic and specific aspects of my contribution to the art and, therefore, such adaptations should and are intended to be comprehended within the meaning and range of equivalence of the claims. What is claimed as new and desired to be protected by Letters Patent is set forth in the appended claims.

I claim:

1. In a centrifugal pump assembly, particularly in an upright centrifugal pump assembly for use in nuclear reactor plants, a combination comprising a motor shaft; a pump shaft coaxial with and spaced apart from said motor shaft; a stationary housing intermediate said shafts; an intermediate shaft coaxial with said first mentioned shafts and rotatable in said housing; bearing means provided in said housing for said intermediate shaft; a first coupling between said motor shaft and said intermediate shaft; and a second coupling between said pump shaft and said intermediate shaft, said intermediate shaft being movable axially in said housing relative to said motor shaft and said pump shaft between first and second positions in which said second coupling is respectively engaged and disengaged.

2. A combination as defined in claim 1, wherein said first coupling is a flexible coupling.

3. A combination as defined in claim 2, wherein said flexible coupling comprises a first coupling element on said motor shaft, a second coupling element on said intermediate shaft, and a third coupling element arranged to transmit torque from said first to said second coupling element, at least in said first position of said intermediate shaft, at least one of said second and third coupling elements being movable axially with said intermediate shaft.

4. A combination as defined in claim 3, wherein said third coupling element is a sleeve having first internal teeth meshing with external teeth provided on said first coupling element and second internal teeth meshing with external teeth provided on said second coupling element, said one coupling element being said second coupling element and said second coupling element being movable with said intermediate shaft axially of said sleeve.

5. A combination as defined in claim 1, further comprising an apertured enclosure supporting said housing.

6. A combination as defined in claim 1, wherein said second coupling is a rigid coupling.

7. A combination as defined in claim 6, wherein said rigid coupling comprises a first coupling element provided on said pump shaft and a second coupling element provided on said intermediate shaft and mating with said first coupling element in said first position of said intermediate shaft.

8. A combination as defined in claim 6, wherein said intermediate shaft has an end face provided with a first set of teeth and said pump shaft has an end face provided with a second set of teeth mating with the teeth of said first set in the first position of said intermediate shaft, said teeth forming part of said rigid coupling and said rigid coupling further comprising means for normally holding said intermediate shaft against axial movement from said first position to thereby maintain the teeth of said first set in mesh with the teeth of said second set.

9. A combination as defined in claim 1, wherein said intermediate shaft is located at a level above said pump shaft but below said motor shaft.

10. In a centrifugal pump assembly, particularly in an upright centrifugal pump assembly for use in nuclear reactor plants, a combination comprising a motor shaft; a pump shaft coaxial with and spaced apart from said motor shaft; a stationary housing intermediate said shafts; an intermediate shaft coaxial with said first mentioned shafts and rotatable in said housing; friction bearing means provided in said housing for said intermediate shaft; a first coupling between said motor shaft and said intermediate shaft; and a rigid second coupling between said pump shaft and said intermediate shaft, said intermediate shaft being movable axially in said housing between first and second positions in which said second coupling is respectively engaged and disengaged, said intermediate shaft having an end face provided with a first set of teeth and said pump shaft having an end face provided with a second set of teeth mating with the teeth of said first set in the first position of said intermediate shaft, said teeth forming part of said second coupling and said second coupling further comprising means for normally holding said intermediate shaft against axial movement from said first position to thereby maintain the teeth of said first set in mesh with the teeth of said second set, said means for holding comprising a composite sleeve surrounding said sets of teeth and connecting said pump shaft to said intermediate shaft.

* * * * *